US010363531B2

(12) United States Patent
Hellmaier

(10) Patent No.: US 10,363,531 B2
(45) Date of Patent: Jul. 30, 2019

(54) BEVERAGE PRODUCING SYSTEM COMPRISING A DISPOSABLE CONTAINER

(71) Applicant: Robert Maierhofer GbR, Eppingen-Rohrbach (DE)

(72) Inventor: Franz Hellmaier, Salzburg (AT)

(73) Assignee: Robert Maierhöfer GbR, Eppingen-Rohrbach (DE)

( * ) Notice: Subject to any disclaimer, the term of this patent is extended or adjusted under 35 U.S.C. 154(b) by 592 days.

(21) Appl. No.: 14/902,657

(22) PCT Filed: Jul. 1, 2014

(86) PCT No.: PCT/EP2014/063922
§ 371 (c)(1),
(2) Date: Mar. 3, 2016

(87) PCT Pub. No.: WO2015/000880
PCT Pub. Date: Jan. 8, 2015

(65) Prior Publication Data

US 2016/0166999 A1 Jun. 16, 2016

(30) Foreign Application Priority Data

Jul. 1, 2013 (DE) ..... 10 2013 212 809

(51) Int. Cl.
*B67D 1/08* (2006.01)
*B67D 3/00* (2006.01)
(Continued)

(52) U.S. Cl.
CPC ..... *B01F 15/0292* (2013.01); *B01F 5/008* (2013.01); *B65D 85/8043* (2013.01);
(Continued)

(58) Field of Classification Search
CPC ..... A47J 31/41; A47J 31/402; A47J 31/46; B01F 15/0292; B01F 5/008;
(Continued)

(56) References Cited

U.S. PATENT DOCUMENTS 2,609,974 A * 9/1952 Brous ..... F16K 31/0651 222/442
3,258,166 A * 6/1966 Kuckens ..... B67D 3/00 222/479
(Continued)

FOREIGN PATENT DOCUMENTS

DE 36 22 777 A1 2/1988
DE 42 26 580 A1 2/1993
(Continued)

OTHER PUBLICATIONS

International Search Report for corresponding patent application No. PCT/EP2014/063922 dated Sep. 23, 2014.
(Continued)

*Primary Examiner* — Patrick M. Buechner
(74) *Attorney, Agent, or Firm* — Renner, Otto, Boisselle & Sklar, LLP

(57) ABSTRACT

A beverage preparation system for making hot or cold beverages includes a beverage dispenser which comprises an electromagnet and a control unit for controlling the electromagnet. The system further comprises a new disposable container for beverage ingredients, which comprises a magnetically actuated dispensing means having an anchor that is movable between an open and a closed position. When the anchor opens the dispensing means in the open position, a continuous flow of beverage ingredients from the reservoir through and from the dispensing means occurs.

20 Claims, 6 Drawing Sheets

(51) Int. Cl.

| | |
|---|---|
| ***B01F 5/00*** | (2006.01) |
| ***B01F 15/02*** | (2006.01) |
| ***B67D 3/02*** | (2006.01) |
| ***B65D 85/804*** | (2006.01) |

(52) U.S. Cl.
CPC ..... *B67D 1/0888* (2013.01); *B67D 3/0019* (2013.01); *B67D 3/0032* (2013.01); *B67D 3/02* (2013.01)

(58) Field of Classification Search
CPC ..... B67D 2210/00144; F16K 27/029; F16K 27/048; F16K 31/082
USPC ..... 222/504
See application file for complete search history.

(56) References Cited

U.S. PATENT DOCUMENTS

| | | | | | |
|---|---|---|---|---|---|
| 3,342,384 | A * | 9/1967 | Jacobs | B67D 3/00 | 222/481 |
| 3,848,775 | A * | 11/1974 | Possell | B65D 83/262 | 222/453 |
| 4,261,485 | A * | 4/1981 | Borg | B65D 47/24 | 137/38 |
| 4,378,079 | A * | 3/1983 | Kuckens | G01F 11/38 | 222/333 |
| 4,450,987 | A * | 5/1984 | Boettcher | A47J 31/402 | 222/105 |
| 4,624,395 | A * | 11/1986 | Baron | A47J 31/401 | 222/129.1 |
| 5,133,482 | A * | 7/1992 | Burrows | B67D 3/0003 | 222/185.1 |
| 7,578,419 | B2 * | 8/2009 | Greenwald | B67D 1/0079 | 222/333 |
| 2002/0104854 | A1 * | 8/2002 | Jensen | B67D 3/0003 | 222/481.5 |
| 2006/0000851 | A1 * | 1/2006 | Girard | A47J 31/407 | 222/129.1 |
| 2007/0241298 | A1 * | 10/2007 | Herbert | F16K 7/16 | 251/129.04 |
| 2009/0266849 | A1 | 10/2009 | Greenwald et al. | | |
| 2010/0108723 | A1 * | 5/2010 | Chassaing | B44D 3/127 | 222/504 |
| 2010/0327202 | A1 | 12/2010 | Birkelund | | |
| 2012/0104020 | A1 * | 5/2012 | Cur | B67D 1/0001 | 222/1 |
| 2012/0326065 | A1 * | 12/2012 | Ferguson | B60T 8/363 | 251/129.15 |

FOREIGN PATENT DOCUMENTS

| | | | |
|---|---|---|---|
| DE | 690 06 161 | T2 | 6/1994 |
| DE | 691 17 050 | T2 | 6/1996 |
| DE | 103 06 537 | A1 | 8/2004 |
| DE | 103 06 567 | A1 | 8/2004 |
| DE | 602 01 094 | T2 | 10/2005 |
| DE | 10 2008 011573 | A1 | 10/2009 |
| EP | 0423045 | A1 | 4/1991 |
| EP | 1227058 | A1 | 7/2002 |
| GB | 1 591 803 | A | 6/1981 |
| WO | 92/09522 | | 6/1992 |
| WO | 2012/113457 | A1 | 8/2012 |

OTHER PUBLICATIONS

Written Opinion for corresponding patent application No. PCT/EP2014/063922 dated Sep. 23, 2014.

* cited by examiner

BEVERAGE PRODUCING SYSTEM COMPRISING A DISPOSABLE CONTAINER

1. FIELD OF THE INVENTION

The present invention relates to a beverage preparation system comprising a beverage dispenser, such as a cold beverage dispenser or a hot beverage dispenser, as typically used in companies, schools, administration and the like.

2. TECHNICAL BACKGROUND

It is known to use in beverage dispensers so called bag-in-box packages to provide beverage ingredients, such as juice, juice concentrates, lemonade, lemonade concentrates, water, milk, coffee, cocoa, tea or the like. Such bag-in-box packages comprise typically an inner bag, consisting of a flexible material, such as a film compound material, which is arranged in a mechanical stable secondary packaging, e.g. of card board. The use of bag-in-box systems is advantageous, since the beverage ingredients are ideally from the filling until final use under air exclusion. Further, such systems can be produced with low costs and can be disposed and recycled easily after being used.

The beverage ingredients in the inner bag can be dispensed, depending on the desired use via different valves. For example, for the applications in domestic use, manually operable nozzles are used, which are directly applied on the bag-in-box system. For applications, which require a frequent exchange of the bag, e.g. draft dispensers, in the field of gastronomy, it is known to use membrane seals, in which the membrane is pierced by a respective pin during insertion of the bag into the draft dispenser, or a lock pin of a re-closable bag-in-box system, which lock-pin is provided in form of an axial movable pin that is biased by means of a compression spring, is constantly pressed open by means of a counter pin. For automated use, for example in beverage dispenser systems, as arranged in public spaces, such as schools or larger enterprises, electronically operable valves can be used which are controlled by suitable analog or digital control units.

A gastronomical application of a bag-in-box system, as disposable beer barrel, is described in DE 103 06 537 A1. This disposable beer barrel essentially comprises a dimensionally stable covers, in the form of a cylindrical tube, made of card board, in which a storage bag for the beer is provided. This one is sealed, as described above with a membrane seal, which is pierced with a respective pin for tapping.

A bag-in-box system for being used in automated beverage dispensers, is described in DE 36 22 777 A1. In this document, bag-in-box packages are described in form of dimensionally stable ashlers having a film bag, comprised therein, which are used for providing beverage ingredients such as water, carbonized water and beverage concentrates. Similar to the above described membrane seal, the film bag according to DE 36 22 777 A1 for being used in a beverage dispenser is closed with a film cap, which is removed for using the package within the beverage dispenser, and which is replaced by a dispensing means, which is used for the dosed dispension of beverage ingredients. This dispensing means is a complex provision, comprising a housing cap and a hollow cylinder, in which a control slider, having a ferro-magnetic anchor, is arranged. This control slider is a pipe shaped component that is supported between an open and closed position movably in the dispensing means. Between these positions, the control slider, comprising the ferro-magnetic anchor, can be moved back and forth by means of a magnetic field, generated by an electromagnet. In the closed position, the control slider seals a dispensing opening of the dispensing means, so that no beverage ingredients can exit to the outside. In this position of the slider, simultaneously a connection between the film bag and the dispensing means is open so that beverage ingredients can flow out of the film bag in a respective complex metering chamber of the dispensing means by means of gravity, until these dispensing chamber is completely filled with beverage ingredients. During moving of the slider from this position into the open position, a dispensing opening of the dispensing means is opened and simultaneously, the connection between the film bag and the dispensing means is closed. Thus, the amount of beverage ingredient measured by the volume of the metering chamber, is dispensed regulated through the dispensing opening, wherein during the dispensing process no beverage ingredient can reflow from the film bag.

A disadvantage of conventional beverage dispensers is that in particular, the corresponding relatively complex valve systems can be cleaned just under significant expense from residues of beverage ingredients. Further, the typically used hose or pipe lines are also work incentive or not at all completely to clean. Therefore, it is often only under high expenses possible to guarantee sufficient hygienic requirements and therefore, it is the object of the present invention to provide an improved beverage preparation system, which can prevent the above described hygienic problems.

3. SUMMARY OF THE INVENTION

The initially mentioned problems are solved by a beverage preparation system described herein.

According to the present invention, a beverage preparation system for hot or cold beverages is provided. Common hot beverages are for example coffee, tea or cocoa formulations. Common cold beverages are for example fruit juice, mixed drinks, comprising different juices or juice concentrates or mixtures thereof with carbonized water as well as lemonade formulations or the like. This beverage preparation system comprises a beverage dispenser, which comprises at least one electromagnet and a control unit, which is adapted to control the electromagnet. The beverage dispenser can be a small machine for use in domestic households, but is preferably a machine for a commercial setup in public buildings, such as schools, enterprises, governmental agencies etc. The control unit may for example be an analog or digital control electronic, which is adapted to switch on and off the electromagnet and to control the intensity of the current, flowing through the electromagnet, and the electrical voltage applied to the electromagnet. In preferred embodiments, the electromagnet generates a magnetic field in the area of the anchor, having a strength in the range of 0.2 to 2 T more preferably, from 0.3 to 1.5 T and most preferably from 0.4 to 1.2 T.

Further, beverage preparation system comprises at least one disposable container for beverage ingredients, which is adapted to be replaceable inserted into the beverage dispenser. Typical beverage ingredients are hereby juices, juice concentrates, water, coffee, cocoa, milk, alcoholic beverages or similar beverage ingredients, as they are typically required in beverage dispensing systems for the production of the standard hot or cold beverages. The disposable container comprises a reservoir and a dispensing means with an anchor. In this case, the reservoir is preferably a flexible bag as typically used in bag-in-box systems, preferably a bag of a film material or a film composite material, such as aluminum/HDPE or polyethylene. The bag may in other embodiments consist of other suitable flexible materials as they are common for a person skilled in the art. The dispensing means can be formed as integral part of the disposable container, or alternatively as a modular pluggable component for an already existing system. In this alternative, the disposable container can be a typical bag-in-box system, wherein the dispensing means is connected by means of form fit to the existing dispensing means of the bag-in-box system.

The beverage ingredient, stored in the reservoir can be withdrawn from the reservoir via the dispensing means, wherein the anchor is arranged moveable on the dispensing means, in order to open the dispensing means for a continuous through flow of beverage ingredients from the reservoir through and out of the dispensing means, when it is in the open position. Hereby, it is essential, that the anchor enables in the open position a continuous through flow through the dispensing means, so that for example a metering chamber of the dispensing means is not first of all filled, which content is then dispensed from the disposable container. This offers the advantage that a subsequent costly cleaning of a complex metering chamber is not required and an improved hygiene is achieved. Continuous in the sense of the present invention means, that the anchor in the open position opens the reservoir of the disposable container for a through flow, which lasts as long as the reservoir is either emptied or as the anchor is removed again in the closed position. The dispensing means therefore comprises preferably no metering chamber.

For moving, the anchor can for example be supported within the dispensing means by suitable guiding elements and can be equipped with radial sealing members such as o-rings, or can be equipped with axial sealing members such as a sealing cone or sealing faces on the front face. In a preferred embodiment, the anchor comprises at least a partial plastic covering and is preferably mainly a massive metal pin. The plastic covering can preferably be suitable to provide a sealing functionality.

The disposable container is suitable for the interchangeable insertion and can therefore be inserted into a suitable insert within the beverage dispenser for the required time span of use, or alternatively can be arranged outside on or at the beverage dispenser for being used. After being used, the disposable container is removed and disposed together with the dispensing means and the anchor, from or out of the beverage dispenser. In other words, the complete disposable container and in particular the dispensing means with the anchor is disposed, which is contaminated with beverage ingredients, so that in particular no complex valve components, remain, as known from the prior art, which require a costly cleaning.

This is inter alia achieved, in that the anchor is adapted, that it can be operated contact free from the outside, namely through the effect of a magnetic field, that is generated from the at least one electromagnet. Preferably, this is realized in that at least a part of the anchor consists of a magnetizable material and is preferably metallic. In other words, it will become possible, that the anchor is moved by the effect of e.g. a magnetic field that is preferably generated by an electromagnet that is arranged at least partly around the dispensing means.

In a preferred embodiment, the control unit is adapted to move the anchor for a predetermined period of time into the open position by controlling the electromagnet, wherein the amount of beverage ingredient, which flows out of the reservoir out of the disposable container through the dispensing means can be adjusted by the duration of the period of time. Therefore, it becomes possible that the liquid flow through the dispensing means is exclusively predetermined by the control unit, and for example a metering chamber can be omitted that has to be costly cleaned. Therefore, an infinitely variable universal control of the through flow is provided, which is not dependent on predetermined sized volumes (such as metering chambers), and additionally the otherwise required costly cleaning of such sized volumes is omitted.

Preferably, the dispensing means is in a preferred embodiment provided as an integral component of a bag-in-box bag and preferably comprises besides the anchor, and optionally provided spring elements and a counter anchor, no further metallic elements. Herein integral means, that the dispensing means, e.g. as plastic part is welded, glued or similar fixedly secured to a bag, manufactured from a plastic.

In other words, the dispensing means, in a preferred embodiment, is non-releasable connected with the reservoir and cannot be removed from the reservoir without destroying the disposable container thereby. Such a design offers the advantage, that a disposable container can be manufactured cost effective as an integrally formed plastic component. At the same time, thereby, that the disposable container together with the movable valve components, i.e. the dispensing means and the anchor, can be disposed after use, it is omitted that in the beverage preparation system, for example at such valve components, remaining contaminations are formed. It is for example possible, to use as disposable container an already existing bag-in-box design and providing the commonly used plastic anchor of this design as a metal pin. Since the operation of the anchor occurs contact free, it is possible, to implement the dispensing means cost effectively and relatively simply, and in a preferred embodiment the dispensing means does not comprise besides the anchor any further moveable parts, which are used for opening and closing the disposable container.

In a preferred embodiment, the dispensing means of the disposable container comprises a spring element, which applies a restoring force on to the anchor, which is directed opposite to a movement of the anchor, that is effected by the magnetic field, and that is preferably directed opposite to a movement of the anchor from the closed position into the open position. For example, the magnetic field of the electromagnet can be used, to move the anchor from a closed position into an open position, in order to open the dispensing means. In this case, it is advantageous to arrange the spring element so that it urges the anchor from the open position into the closed position, when the magnetic field is switched off, so that when the magnetic field is switched off, the dispensing means is automatically closed again. Alternatively, the spring element can be arranged, so that it urges the anchor into the open position and that the magnetic field must be switched on to close the dispensing means.

The disposable container can additionally to the moveable anchor comprise a non-moveable counter anchor in a preferred embodiment. For example, the counter anchor can be fixed within the dispensing means and can serve to fasten the spring element. Simultaneously, the counter anchor can serve as mechanical stop for the moveable anchor, for example to limit the movement of the anchor form a closed into the open position. As will be described in greater detail below, the presence of the counter anchor leads to a collimation of the magnetic field lines. By means of this collimation, the linear respectively axial action of force on the anchor is raised more than three times, so that a secure opening of the dispensing means can be provided, even with using compact magnets. The counter anchor is therefore similarly as the anchor itself preferably a pin shaped component and arranged, so that the longitudinal axis of the anchor and the counter anchor are within the same axis, which corresponds to the axial respectively longitudinal direction of movement of the anchor.

In a preferred embodiment, the beverage dispenser comprises means for generating a low pressure, preferably a technical geometry for generating a low pressure, preferably a venturi nozzle, for suction of the beverage ingredients from the disposable container, preferably from at least one disposable container in the case that the beverage preparation system comprises several disposable containers. Contrary to embodiments according to which the beverage ingredients are exclusively transported out of the disposable container by means of gravity, the use of low pressure for sucking the beverage ingredients comprises the advantage, that by means of the effect of the pressure, the disposable container can be emptied reliable and completely. In particular, the generation of a low pressure offers the possibility, that the container is emptied with a constant through flow of beverage ingredients through the dispensing means. Further, the provision of a constant flow rate facilitates a precise metering of beverage ingredients, which are withdrawn out of the disposable container by controlling the time span in which the dispensing means is open.

In order to facilitate the production of mixed beverages, the beverage preparation system comprises in preferred embodiments at least one further disposable container, wherein the disposable containers can be arranged in the beverage dispenser, so that beverage ingredients, which flow out of a respective disposable container are mixed. Therefore, the beverage dispenser comprises preferably a retainer for the at least two disposable containers and means for mixing the beverage ingredients, which flow out of the respective disposable containers. Preferably, at least one electromagnet is assigned to each of the at least two disposable containers and the control unit is adapted to meter the amount of the respective beverage ingredient, which flows out of the respective dispensing means out of the respective disposable container by controlling the respective electromagnet. Therefore, it becomes possible to control the amount of beverage ingredients, which are disposed from the individual disposable container individually by controlling the respective magnets. Therefore, preferably, predetermined time spans are stored or preprogrammed in the control unit, so that that the control unit meters the through flow of beverage ingredients by controlling the respective electromagnets.

4. DESCRIPTION OF THE PREFERRED EMBODIMENTS

In the following, the invention is described with respect to the accompanying figures, wherein.

Figure 1:
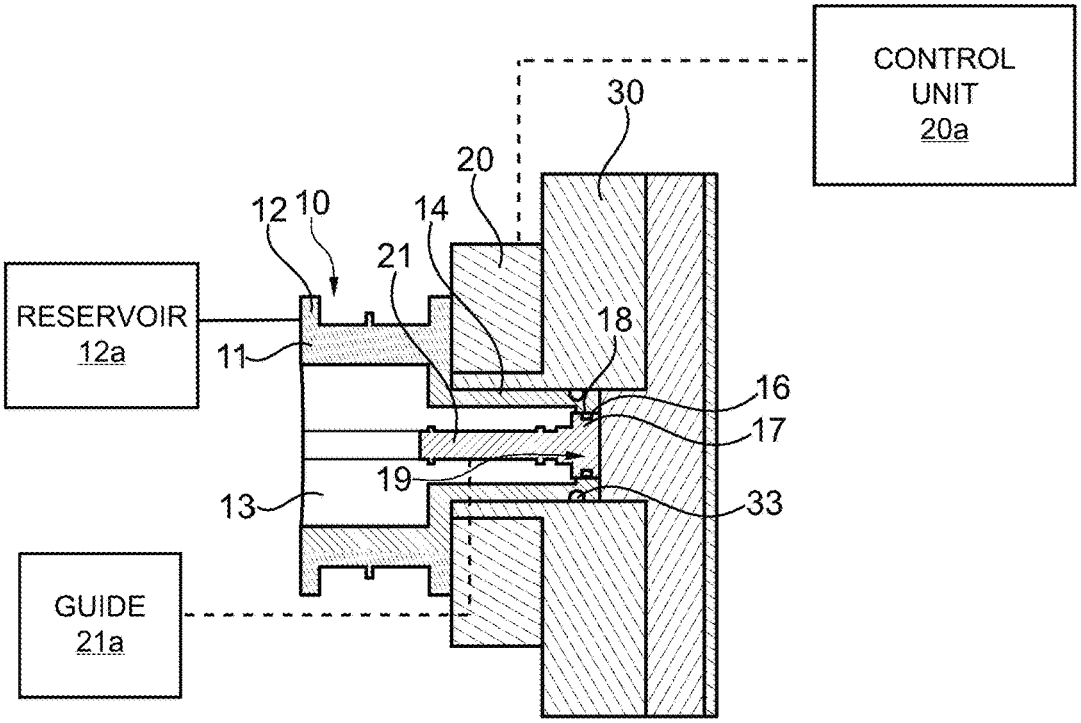
FIG. 1 is a schematic cross section of a dispensing means of a disposable container, which is inserted in respective part of a beverage dispenser.

FIG. 1 is a perspective cut view of a dispensing means 10 of a disposable container, which is inserted into a respective section of the beverage dispenser 30. The dispensing means 10 is in particular a socket shaped element, consisting of a hollow cylinder 11, which encircles a cavity 13. The dispensing means 10 is relieved, in the figure to the right, into a throat 14 of the receptacle of the beverage dispenser, which is exchangeable inserted. In alternative embodiments, the dispensing means can be exchangeable inserted into a respective receptacle of a beverage dispenser, entirely or the throat can have a different suitable geometry as the skilled person in the art will provide advantageously.

The dispensing means is exchangeable fixed in the receptacle of the beverage dispenser, in that, e.g. at the throat 14 suitable clip or locking means are provided, which cooperate with respective locking or clipping means of the receptacle of the beverage dispenser. Further, preferably sealing means are provided on the dispensing means 10, such as for example an O-ring 33 that is, as illustrated in the figure, arranged between respective walls of the throat 14 and the receptacle of the beverage dispenser. Further, or as an alternative to the O-ring 33, axial sealing elements, such as sealing cones or sealing elements that are applied on a front face, can be provided. The sealing means serve to protect the construction against the exit or entrance of liquids or moisture.

On the far side of the dispensing means 10 from the beverage dispenser, a fixing rib 12 is arranged, which serves to fix a reservoir 12*a* at the dispensing means. In a preferred embodiment, the disposable container consists in particular of a dispensing means and the reservoir 12*a*. In a further preferred embodiment, the disposable container further includes a dimensionally stable packaging, such as made from card board, in which at least the reservoir 12*a* is held. Preferably, the reservoir 12*a* is non releasably connected to the dispensing means 10, for example by means of gluing, or welding of a respective area of the reservoir 12*a* on the fixing rib 12. The reservoir 12*a* is preferably a flexible bag which is manufactured in preferred embodiments from a film material or a film compound material. It serves to provide beverage ingredients, such as juice, juice concentrate, water milk, alcoholic beverages, coffee or cocoa formulations. Within the dispensing means, a pin shaped anchor 21 is moveably supported by means of a suitable anchor guide 21*a*, which is shown in FIG. 1 in a closed position. The anchor guide includes a guiding known to the person skilled in the art, such as gliding ribs or distributor valves or the like (schematically shown in the figure). In the illustrated closed position, a sealing section 17 of the anchor seals an out flow opening 19 of the dispensing means 10 and shuts the dispensing means for the through flow of beverage ingredients out of the reservoir through and out of the dispensing means. The anchor is supported in the dispensing means, so that it can be moved from the closed position, in FIG. 1 to the left, into an open position, in which it opens the out flow opening 19 for a through flow of beverage ingredients. As it is derivable from FIG. 1, in this case, the anchor opens the outflow opening 19 and therewith the dispensing means 10 for a continuous through flow of beverage ingredients out of the reservoir through and out of the dispensing means 10.

In order to suitably seal the dispensing means in the closed position against a through flow of beverage ingredients, preferably respective closing elements in form of a recess 16 of the anchor 21 and a nose 18 of the dispensing means 10 are provided on the anchor and at the throat of the dispensing means, which engage with each other, if the anchor 21 is in the closed position.

Preferably, the dispensing means is made from a plastic material, for example by means of an injection mold method. The anchor consists at least partially of a magnetizable material, preferably of a metal and can, in a preferred embodiment, be a surface coated, e.g. plastic coated, metal pin. In particular, the anchor is particularly massive in a preferred embodiment, thus it does not comprise, besides possibly necessary boreholes, further cavities, which for example serve for the metering of beverage ingredients. Such a plastic coating can for example serve for the sealing of the dispensing means 10 against a through flow of beverage ingredients in conjunction with an inner wall of the throat 14, if the anchor 21 is in the closed position.

In FIG. 1 further, an electromagnet 20 is schematically illustrated, which is at least partially arranged around the dispensing means and the anchor. It serves to operate the anchor contact free between the closed position and the open position back and forth. Therefore, a control unit 20*a* is provided at the beverage dispenser, with which the electromagnet can be simply switched on or switched off in the simplest case. Upon switching on the electromagnet generates a magnetic field, which is arranged to generate a force that moves the anchor.

Figure 2:
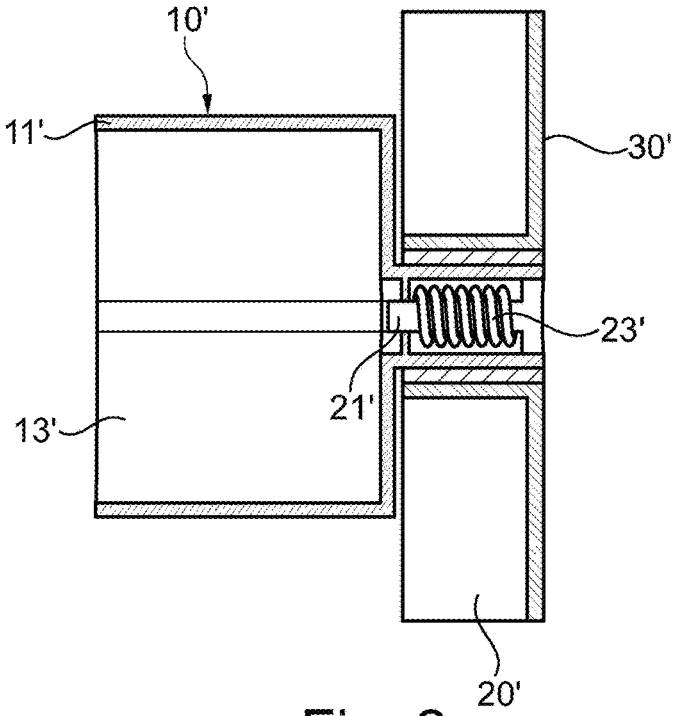
FIG. 2 is a schematic cross section of a further embodiment of the dispensing means.

In FIG. 2, a further embodiment of a dispensing means 10' having a hollow cylinder 11' and a cavity 13' is shown. In this case, the anchor 21' is supported via a spring element 23', for example as a part of the anchor guiding, which spring element is in form of a metal spiral, in the throat 14' of the dispensing means 10'. The spring element 23 serves to generate a restoring force onto the anchor, if this anchor is moved from the closed position into an open position. In other words, force, that is generated by the magnetic field of the electromagnet 20' to move the anchor 21' from the closed position into the open position should have a suitable force to overcome the restoring force, that is generated from the spring element 23'. In a preferred embodiment, the anchor 21' is maintained in the open position by the force of the magnetic field and moves, driven by the spring element 23' automatically back in the closed position, if the electromagnets 20' is switched off. In other embodiments, this process can be reversed, so that the spring element drives the anchor into the open position.

As it is derived from FIGS. 1 and 2, the moveable valve components, dispensing means and anchor, which are used for a dispensing and metering of beverage ingredients are provided as part of the disposable container, according to the inventive beverage preparation system. This disposable container is disposed and replaced by a new disposable container, when the reservoir is emptied. Therefore, no with beverage ingredients contaminated valve components remain at the beverage dispenser, which have to be cleaned with high expense. In particular, by contact free operating of the anchor by means of the magnetic field of the electromagnet, it is avoided that an opening of the disposable container, for example by means of an above described pin, which remains contaminated by beverage ingredients after use of the disposable container at the beverage dispenser. The contact free operation of the anchor and the disposal of the movable valve components after use, together with the disposable container allow therefore significantly improved hygienic conditions. Due to the simple structure, the disposal use of such containers is possible in view of economic reasons, since the inventive dispensing means can be manufactured very cost effective.

In preferred embodiments of the invention, particular good hygienic conditions can be obtained, if the components of the beverage dispenser are provided according to the novel construction method. As it is described in detail in the earlier patent application of the same applicant with the international file No. PCT/EP 2011/052803. This application is incorporated by reference entirely. In this application, as a component of a beverage dispenser, an improved reusable mixing device, respectively frothing device for the use in beverage dispensers is described, wherein this one is combined of at least two components and wherein at least one of the two components comprises on its surface recesses. In assembled condition of the components, these recesses form together with a further surface of the other component closed channels, which serve for the transportation of beverage ingredients. An advantage of such a construction is that those two components can be easily separated and withdrawn from the beverage dispenser, so that they can be cleaned easily after use, e.g. in a dish washer.

Figure 3:
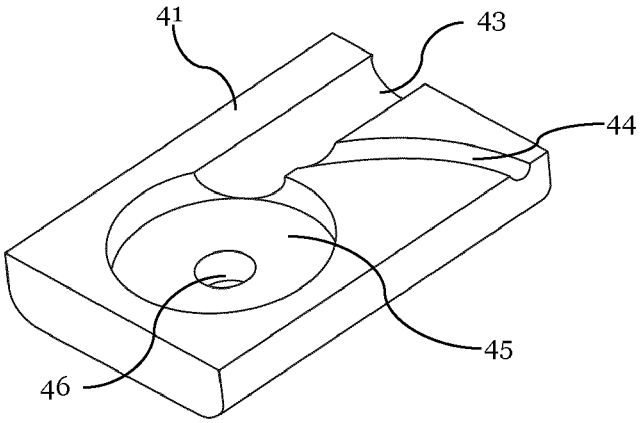
FIG. 3 is a schematic view of a first component of an element of a beverage dispenser.

Exemplarily, components of this novel beverage dispenser are depicted in the following FIGS. 3 to 6. FIG. 3 shows a first component 41 of a nozzle system for the use in a beverage dispenser. As mentioned, it is a particular advantage of this novel system that due to the use of recesses in a component, channels are generated, that are either closed by a surface or complimentary recesses of a secondary component and which can be used in the connected state of the components for the transport of beverage ingredients. Contrary to known hoses or pipe lines, such as typically used in beverage dispensers, the single components of the novel beverage dispenser can be separated after use in a simple manner and can be completely cleaned in a dish washer.

By providing channels in form of recesses in a component, also complex arrangements of pipe lines can be provided. For example it is possible to provide means for generating a low pressure by means of a technical geometry for the generation of low pressure, such as a venturi arrangement of the pipe lines, as illustrated in FIG. 3. According to this venturi arrangement a first guiding recess 43 and a second guiding recess 44 are connected to a mixing recess 45, so that when liquid is guided through the first guiding recess 43 low pressure is generated in the second guiding recess 44. For example, in a first guiding recess 43 coffee can be guided and through the venturi principle, milk is sucked through the second guiding recess 44. The coffee milk mixture is then suitably mixed in the mixing recess 45 and exits the beverage dispenser through the outflow opening 46. This principle can, if necessary by suitable adaption, such as providing further guiding recesses and/or using other cross section ratios of the recesses, also be used for other beverage mixtures such as fruit juice mixtures.

Figure 4:
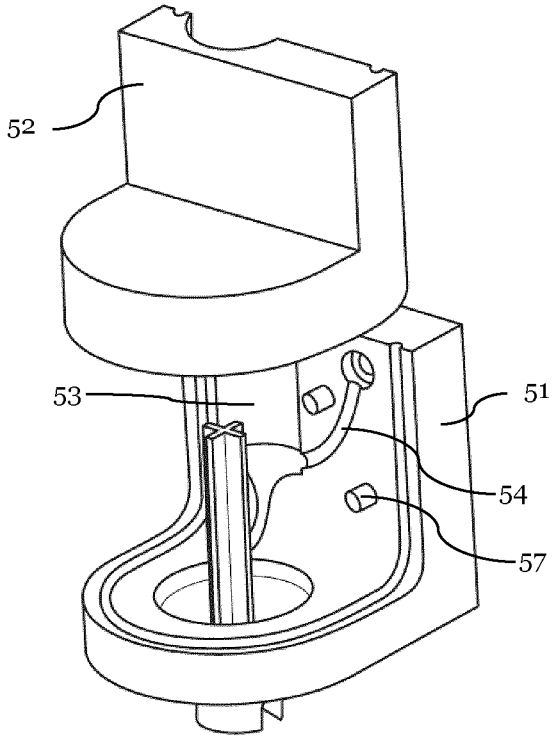
FIG. 4 shows a three-dimensional view of a first and second component of elements of a beverage dispenser.

FIG. 4 is a three-dimensional illustration of a further embodiment of the first component 51 and a second component 52, wherein a further venturi arrangement of recesses is shown in a three-dimensional arrangement. Herewith, the first and second guiding recesses 53, 54 are manufactured in the first component 51, wherein respective complimentary recesses are provided on the second component 52. The components 51, 52 can be separable fixed together by means of coupling elements 57. In other words, the coupling elements, are preferably arranged so that a repeated connecting and separating of the first and second components is enabled. In further preferred embodiments, the components can be assembled in a similar manner as described above from more than two components.

Figure 5:
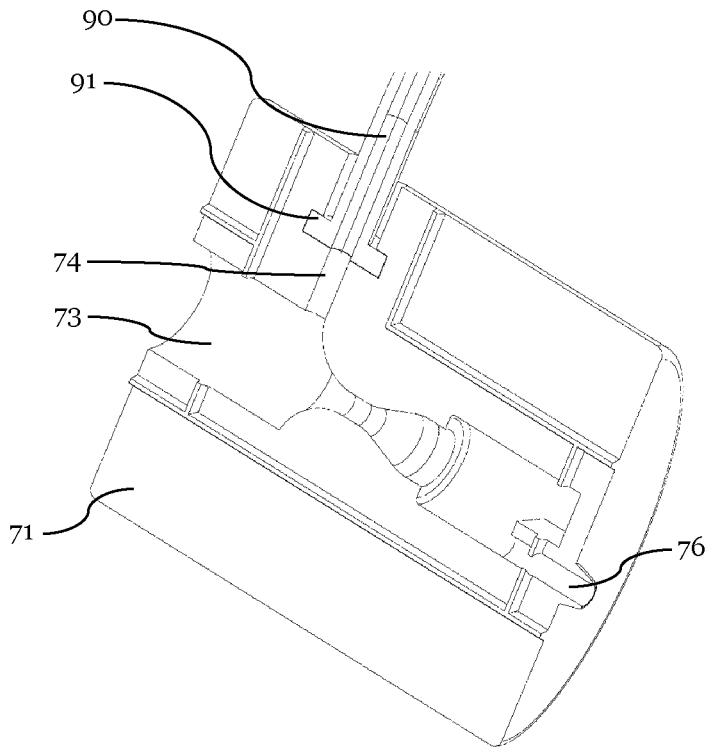
FIGS. 5 and 6 show schematic illustrations of further alternative embodiments of a first component.

In FIG. 5, a further embodiment of a first component 71 with a guiding recess 73 and a second guiding recess 74 is depicted. In this figure, further a connecting pipe 90 is depicted that is fixed via a retaining ring 91 in a respective locking recess of the first component 71. Also the pipe 90 can, similar as the described elements of the beverage dispenser, be provided as two pieces of first and second components and for example can comprise two or more partial pipes that are assembled by respective coupling elements to the pipe shown. Such pipe systems are particularly efficient and completely cleanable due to the multipart design and a particularly good hygiene can be guaranteed. The beverage mixed while using components 71, for example the coffee milk mixture or the fruit juice mixture, can be dispensed through the output 76 for being used.

Figure 6:
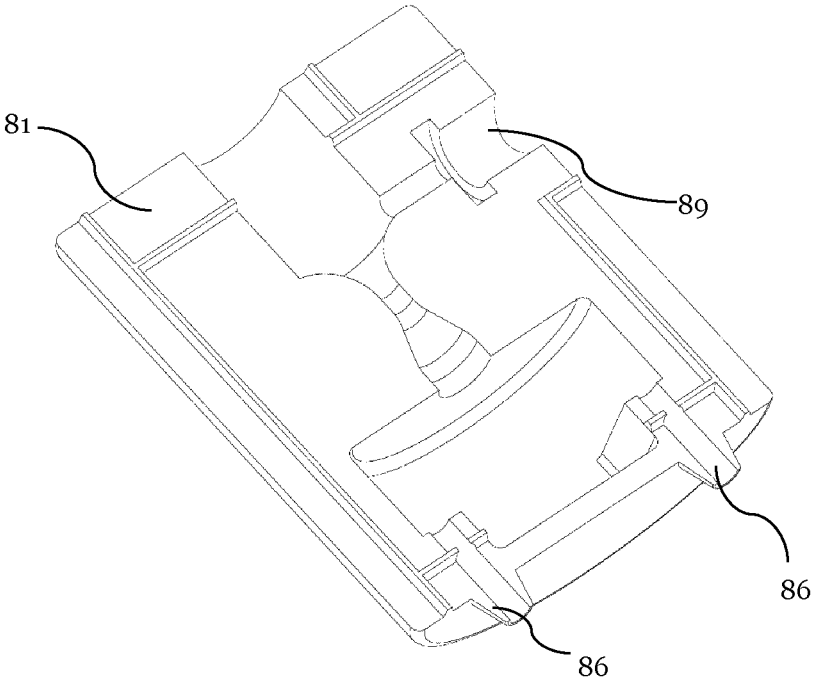

In FIG. 6, a further embodiment of a first component 81 with two outputs 86 is shown. In this view, a recess 89 is visible, which is for example suitable for receiving the above described pipe 90.

Figure 7:
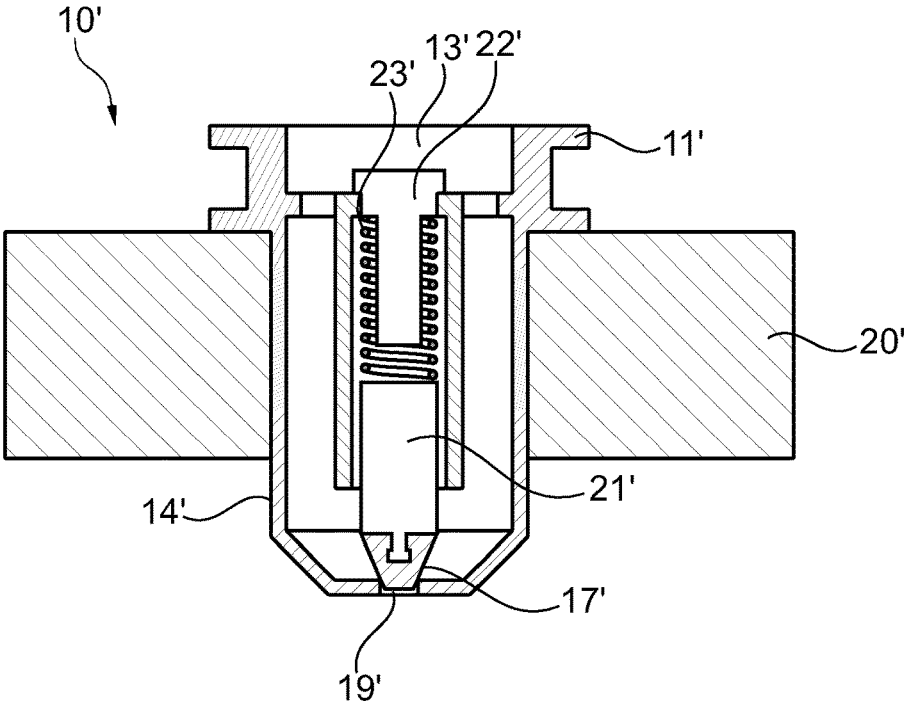
FIGS. 7 and 8 are schematic views of further embodiments of a dispensing means of a disposable container.

FIG. 7 is a schematic cut view of a further embodiment of a dispensing means 10' of a disposable container. The dispensing means 10' comprises as the above described dispensing means 10 a hollow cylinder 11', which surrounds a cavity 13'. A dispensing means 10' is relieved, in the Figure downwardly, into a throat 14', which is arranged within an electromagnet 20', respectively which is surrounded by the electromagnet. The throat 14' can be plugged into the electromagnet, as shown. Alternatively, parts of a receptacle of a beverage dispenser can be arranged between the throat 14' and the electromagnet 20'.

Within the dispensing means 10', a pin shaped anchor 21' is movably supported via a suitable anchor guiding. The anchor 21' is shown in FIG. 7 in a closed position, in which a sealing section 70' of the anchor seals an outflow opening 19' of the dispensing means 10' and thus shuts the dispensing means for the through flow of beverage ingredients out of the reservoir through and out of the dispensing means. In the embodiment shown, the sealing section 70' is depicted as sealing cone. Alternatively, or additionally, O-rings can be provided for sealing.

As described above, with respect to the first embodiment of the dispensing means 10, the anchor 21' is supported in the dispensing means 10' so that it can be moved from a closed position, in FIG. 7 to the top, in an open position, in which it opens the outflow opening 19' for the through flow of beverage ingredients. A pin shaped counter anchor 22' is arranged so that the longitudinal axes of the anchor 21' and the counter anchor 22' are arranged in the same axis, which corresponds to the axial respectively longitudinal direction of movement of the anchor. The fixed counter anchor serves in this open position inter alia as mechanical stop, in order to limit the movement of the anchor 21' from the closed in the open position. The counter anchor 22' serves further as mount for the spring element 23' that as described above, provides a restoring force onto the anchor, if it is moved from the closed position into an open position. Due to the restoring force, the anchor 21' is driven from the open position into the closed position, if the electromagnet 20' is switched off. However, the main function of the counter anchor 22' is to bunch the magnetic field lines and to let those flow target orientated over the front face of the counter anchor into longitudinal direction of the movable anchor. Due to this orientation and bunching, a significant increase of linear and axial force on the anchor can be achieved, generated by the deflection of the radial field lines in axial direction. Experiments have shown, that by the use of a counter anchor, the axial induced force for overcoming the spring force can be increased three times to four times, while support forces of the movable anchor are simultaneously reduced. For this purpose, the counter anchor should be as shown, at least partially arranged within the magnet 20' in order to exert influence on the magnetic field.

Figure 8:
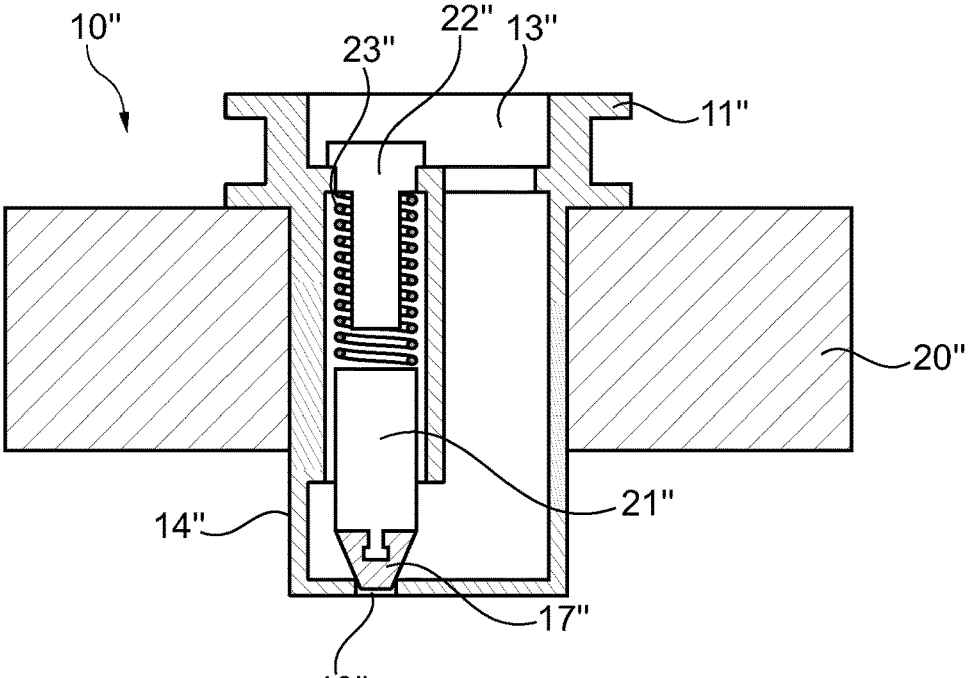

FIG. 8 shows a further embodiment of the dispensing means 10". This embodiment corresponds essentially to the dispensing means 10' and therefore, respective reference signs reference respective parts. In contrast to the embodiment shown in FIG. 7, the anchor 21", according to the dispensing means 10", according to FIG. 8, is not arranged centrically, as the one of FIG. 7, but eccentric. However, also with this respect, the fixed counter anchor 22" as well as the moveable anchor 21" itself is preferably a pin shaped component and arranged so that the longitudinal axis of the anchor and the counter anchor are in the same axis.

Figure 9:
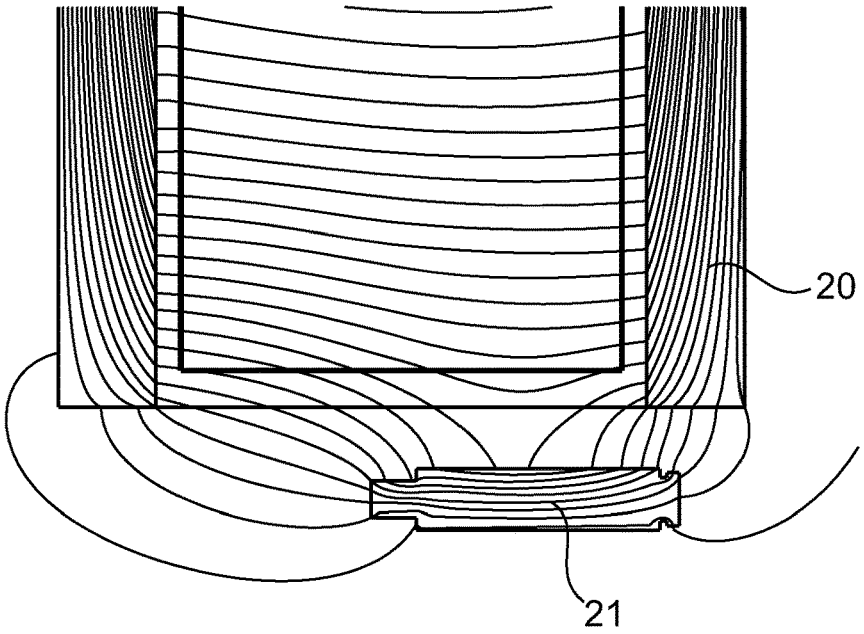
FIG. 9 shows a schematic illustration of magnetic field lines in an execution example without a counter anchor.
Figure 10:
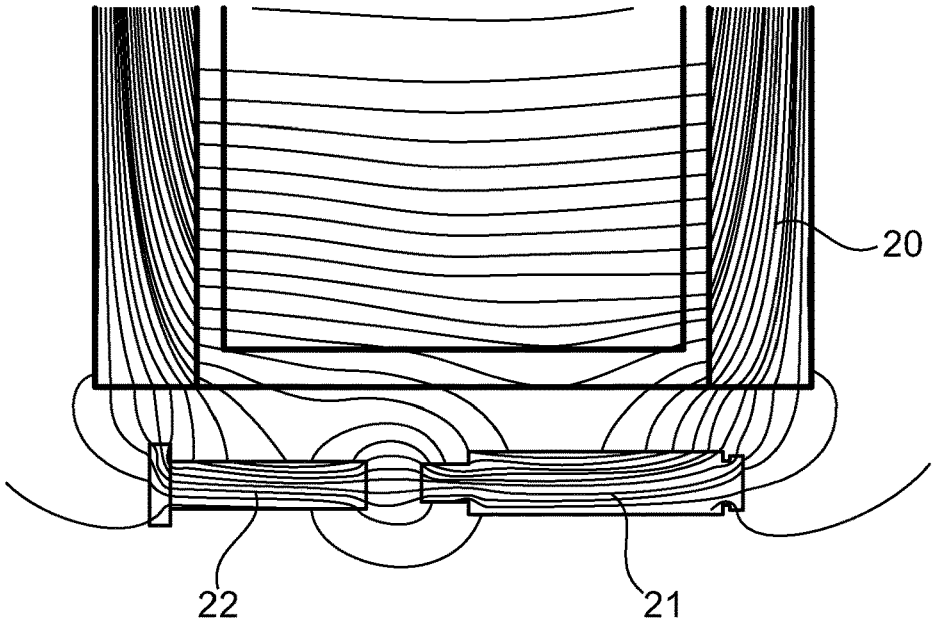
FIG. 10 shows a schematic illustration of magnetic field lines in an execution example with a counter anchor.

In FIGS. 9 and 10, a schematic distribution of magnetic field lines is shown for an execution example with and without an counter anchor. As it is derivable from FIG. 9, without counter anchor, the magnetic forces act with a significant portion in a radial direction, respectively transverse to the longitudinal direction, and therefore to the desired direction of movement of the anchor 21. These magnetic forces therefore are not available for the desired movement of the anchor 21.

When using a counter anchor 22, which is arranged in the same axial direction as the anchor 21, an improved bunching and orientation of the field lines in axial direction occurs. In particular, there exists strong magnetic forces between the anchor 21 and the counter anchor 21, which act in the desired direction of movement, in order to move the moveable anchor 21 in axial direction in the direction of the counter anchor 22. Hereby, the forces acting on the anchor 21 can be significantly increased.

The invention claimed is:

1. A beverage preparation system for providing hot or cold beverages comprising:

a beverage dispenser having at least one electromagnet and a control unit for controlling said electromagnet;

at least one disposable container for beverage ingredients which are adapted for being replaceable and insertable into the beverage dispenser, wherein the disposable container includes a reservoir and a dispensing means having an anchor which is arranged to be movable between an open position and a closed position on the dispensing means, and wherein the anchor is moveable between the open position and the closed position by a magnetic field generated by the at least one electromagnet, wherein the anchor is arranged on the dispensing means and the anchor opens the dispensing means when in the open position for a continuous through flow of beverage ingredients out of the reservoir and through the dispensing means, and wherein the disposable container includes an unmovable counter anchor for the anchor whereby magnetic field lines flow in a bundled arrangement and orientate over a front face of the counter anchor in a longitudinal direction of the anchor, and wherein the counter anchor is fixed within the dispensing means.

2. The beverage preparation system according to claim 1, wherein the control unit is adapted, such that the control unit can move the anchor for a predetermined period of time into the open position by controlling the electromagnet, wherein an amount of beverage ingredients, which flows through the dispensing means out of the reservoir out of the disposable container, can be controlled by the length of the period of time.

3. The beverage preparation system according to claim 1, wherein the dispensing means does not comprise a metering chamber.

4. The beverages preparation system according to claim 1, wherein at least a part of the anchor consists of a magnetizable material and is metallic.

5. The beverage preparation system according to claim 1, wherein a longitudinal axis of the anchor and the counter anchor are arranged in a same axis, which corresponds to an axial, respectively longitudinal, direction of movement of the anchor.

6. The beverage preparation system according to claim 1, wherein the movable anchor and the unmovable counter anchor have an elongated rod shape.

7. The beverages preparation system according to claim 1, wherein only the anchor, spring elements, and the counter anchor are formed of a metallic material.

8. The beverage preparation system according to claim 1, wherein the dispensing means of the disposable container comprises a spring element, which applies a restoring force onto the anchor which is directed opposite to a movement of the anchor effected by the magnetic field, and opposite to a movement of the anchor from the closed into the open position.

9. The beverage preparation system according to claim 1, wherein the dispensing means is connected non-releasably with the reservoir.

10. The beverage preparation system according to claim 1, wherein the dispensing means is socket shaped element, that consists of at least one wall forming a cavity, wherein the anchor is contained therein movably, and an anchor guide, wherein the anchor can be moved between the open position and the closed position due to an effect of the magnetic field within the dispensing means.

11. A method of using a disposable container, comprising a reservoir and a dispensing means with a movable anchor and an unmovable counter anchor for the anchor, in the beverage preparation system according to claim 1, the method comprising:

inserting the disposable container into the beverage dispenser;

operating of the at least one electromagnet to move the anchor, using the counter anchor, from the closed position into the open position, wherein magnetic field lines flow in a bundled arrangement and orientate over a front face of the counter anchor in a longitudinal direction of the anchor, wherein an engagement of a nose of the dispensing means within a recess of the anchor is released in order to allow a continuous through flow of beverage ingredients from the reservoir through and from the dispensing means;

returning the recess of the anchor into engagement with the nose of the dispensing means when the anchor moves from the open position to the closed position;

removing the disposable container with the dispensing means out of the beverage dispenser and disposing the disposable container with the dispensing means; and inserting a new disposable container with a new dispensing means into the beverage dispenser.

12. The beverage preparation system according to claim 1, wherein the anchor has a recess and the dispensing means has a nose that is engageable within the recess when the anchor is in the closed position.

13. The beverage preparation system according to claim 1, wherein the beverage dispenser includes a nozzle system having at least one component of the beverage dispenser comprises at least a first component and a second component, wherein the first component comprises a surface open recess, which form in an assembled state of the at least one component, closed channels or chambers together with a further surface of the second component, with complimentary recesses of the second component, wherein the channels or chambers are adapted to guide beverage ingredients.

14. The beverage preparation systems according to claim 13, wherein the first component and the second component have couplings elements, which allow a repeated connecting and disconnecting of the first component and the second component.

15. A disposable container for installation into a beverage preparation system having a beverage dispenser with at least one electromagnet, the disposable container comprising:

a reservoir and a dispensing means, the dispensing means having an anchor, which is movable between an open and a closed position on the dispensing means by way of a magnetic field generated by the at least one electromagnet, wherein the anchor is arranged on the dispensing means and the anchor opens the dispensing means when in the open position for a continuous through flow of beverage ingredients out of the reservoir and through and from the dispensing means, wherein the disposable container includes an unmovable counter anchor for the anchor whereby magnetic field lines flow in a bundled arrangement and orientate over a front face of the counter anchor in a longitudinal direction of the anchor, and wherein the counter anchor is fixed within the dispensing means.

16. The disposable container according to claim 15, wherein a recess is provided on the anchor and a nose is provided at the dispensing means, which engage with each other when the anchor is in the closed position.

17. The disposable container according to claim 15, wherein at least a part of the anchor consists of a magnetizable material and is metallic.

18. The disposable container according to claim 15, wherein a longitudinal axis of the anchor and the counter anchor are arranged in a same axis, which corresponds to an axial, respectively longitudinal, direction of movement of the anchor.

19. The disposable container according to claim 15, wherein the dispensing means of the disposable container comprises a spring element, which applies a restoring force onto the anchor which is directed opposite to a movement of the anchor effected by the magnetic field, and opposite to a movement of the anchor from the closed into the open position.

20. The disposable container according to claim 15, wherein the dispensing means is connected non-releasably with the reservoir.

* * * * *